United States Patent [19]

Gutierrez et al.

[11] 4,345,713

[45] Aug. 24, 1982

[54] SAFETY LOCK FOR AIR DRIVEN CENTRIFUGE

[75] Inventors: William S. Gutierrez, San Francisco; Lee Gropper, Los Altos; Hugh O. Brown, Campbell, all of Calif.

[73] Assignee: Beckman Instruments, Inc., Fullerton, Calif.

[21] Appl. No.: 254,020

[22] Filed: Apr. 13, 1981

[51] Int. Cl.[3] ..... B04B 7/06

[52] U.S. Cl. ..... 233/1 B; 233/24

[58] Field of Search ..... 233/1 R, 1 A, 1 B, 1 D, 233/23 R, 23 A, 24, 26, 27, 28

[56] References Cited

U.S. PATENT DOCUMENTS

| | | | |
|---|---|---|---|
| 3,163,600 | 12/1964 | Buss | 233/1 B |
| 3,456,875 | 7/1969 | Hein | 233/24 |
| 3,763,670 | 10/1973 | Harroid | 233/1 B |
| 3,958,753 | 5/1976 | Durland et al. | 233/23 R |
| 4,056,225 | 11/1977 | Hein | 233/1 A |
| 4,196,844 | 4/1980 | Jacobson | 233/1 B |

*Primary Examiner*—Robert W. Jenkins

*Attorney, Agent, or Firm*—R. J. Steinmeyer; F. L. Mehlhoff; Al. A. Canzoneri

[57] ABSTRACT

In accordance with the present invention, there is provided an air driven centrifuge having an access door to a rotor chamber housing a rotor seat and a rotor having a plurality of turbine flutes formed in the underside thereof. Air jet means in the rotor seat are provided for supporting and spinning the rotor on an air cushion in the chamber. Means are provided to prevent the opening of the access door when pressurized air is supplied to the air jets, and means are provided to delay for a predetermined period, the opening of the door after the supply of pressurized air to the air jets is discontinued.

6 Claims, 1 Drawing Figure

SAFETY LOCK FOR AIR DRIVEN CENTRIFUGE

BACKGROUND OF THE INVENTION

This invention relates to the field of latching mechanisms and more particularly to automatic means for preventing the opening of an access door to the rotor chamber of an air driven centrifuge while the rotor is rotating.

In many instances the separation of a fluid mixture can be accomplished most expediently by centrifuging it at very high speed. The forces generated by centrifugation cause the heavier constituents of the mixture to settle out or "sediment" in layers according to their respective densities. For any given mixture, the higher the centrifugation speed the less time will be required to achieve a desired degree of sedimentation.

In some instances, such as where it is desired to separate minute viruses such as rubella, or the concentration of immunoglobulines from urine, it is necessary to achieve centrifugation speeds of a magnitude which are presently attainable only by air driven centrifuges. Centrifuges of this type, such as disclosed in U.S. Pat. No. 3,958,753 issued to Durland et al., and assigned to Beckman Instruments, Inc., the assignee of the present invention, are capable of reaching speeds as high as 200,000 R.P.M. Speeds of this magnitude can be achieved, because the rotor of such a machine is supported and rotated on a cushion of air by pressurized air streams, thus eliminating to a large extent the effect of mechanical friction.

The energy possessed by a rotor driven in such a manner is considerable, and could present a hazard to an operator if he were exposed to it by opening the door to the rotor chamber. There is, accordingly, a need for means to prevent the user from opening the access door to the rotor chamber of such a centrifuge while the rotor is rotating.

SUMMARY OF THE INVENTION

In accordance with the present invention, there is provided an air driven centrifuge having an access door to a rotor chamber housing a rotor seat and a rotor having a plurality of turbine flutes formed in the underside thereof. Formed in the rotor seat are driving air jet means for impinging pressurized air streams against the turbine flutes for supporting and spinning the rotor on an air cushion above the rotor seat. Also provided are access door safety lock means for preventing the opening of the door when pressurized air is supplied to the rotor driving air jets, and means for delaying, for a predetermined time, the opening of the door after the supply of pressurized air to the rotor driving air jets is discontinued.

BRIEF DESCRIPTION OF THE DRAWING

The single drawing is a partial cross-sectional elevation view showing the safety lock of the invention.

DETAILED DESCRIPTION

Figure 1:
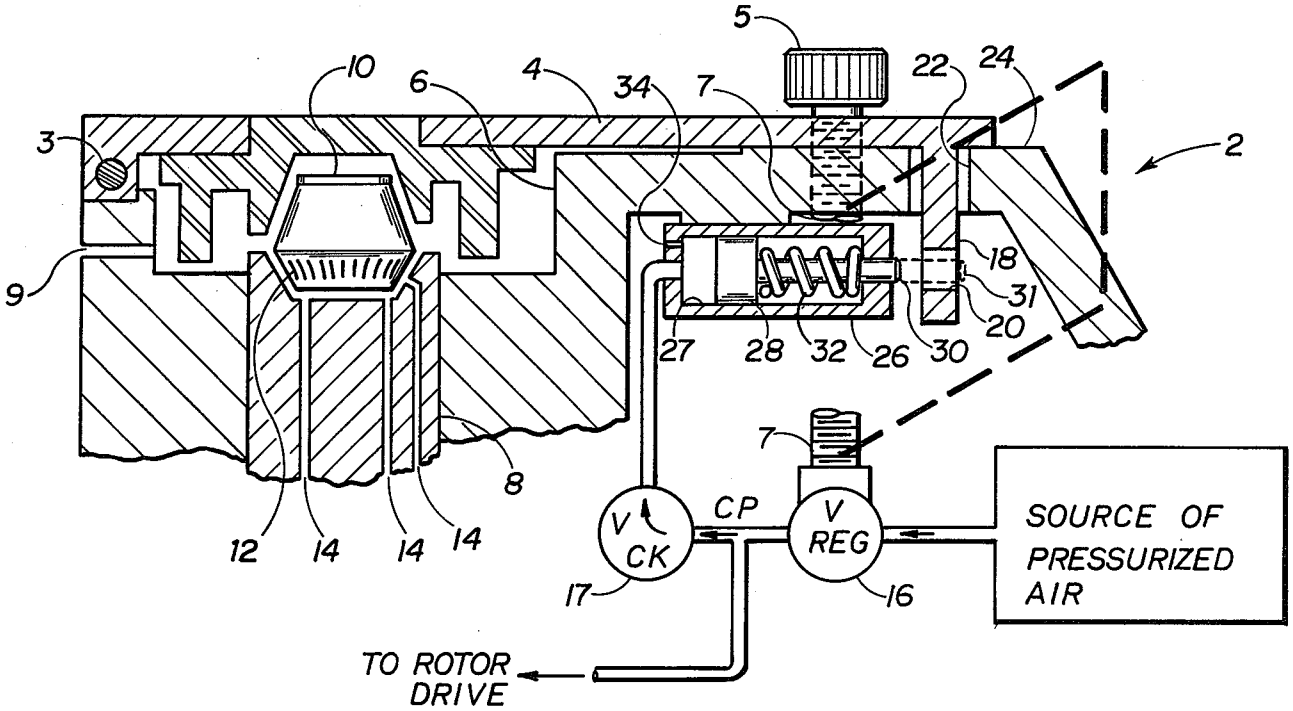

Turning now to the single drawing, there is shown a partial view of an air driven centrifuge 2 having an access door 4 to a rotor chamber 6 housing a rotor seat 8 and a rotor 10. A plurality of turbine flutes 12 are formed in the underside of the rotor 10, and air jets 14 are provided in the rotor seat 8 for impinging pressurized air streams against the turbine flutes 12 to support and spin the rotor 10 on an air cushion above the rotor seat 8. An orifice 9 is provided to allow air flowing past the rotor to be exhausted outside of the centrifuge.

The door 4 is pivoted on a hinge 3, and when in the closed position, is locked by the clamping action of knob 5. The knob 5, which is rotatable and captively mounted on the door 4, has a threaded extension 7 designed to make a threaded engagement with an air pressure regulator 16 mounted inside the centrifuge structure. As the engagement between the threaded extension 7 and the pressure regulator 16 is advanced beyond an initial point, the regulator is actuated. The output pressure and, accordingly, the speed of the rotor 10 is adjusted by turning knob 5. It will be seen, therefore, that when the centrifuge 2 is in operation, the door 4 cannot be opened without first cutting off the supply of driving air by disengaging the extension 7 from the regulator 16. Since it is yet conceivable that the door 4 might, in this way, be opened before the rotor 10 has coasted to a stop, means for preventing such an occurrence are provided by the present invention, and will be described as follows.

Protruding from the underside of the door 4 is a tang-like latch member 18 having a latch hole 20. When the door 4 is in the closed position, the latch member 18 extends through an opening 22 in the centrifuge body 24, and the latch member 18 is positioned proximate an air cylinder 26 mounted inside the body of the centrifuge. The air cylinder 26 has a cylindrical bore 27 containing a piston 28 connected to an actuator rod 30 and loaded by a compression spring 32. When the pressure regulator 16 is actuated and set to operating pressure by means of knob 5, air flows from the regulator to the air jets 14 in the rotor seat 8 to levitate and spin the rotor 10. At the same time, air from the regulator 16 also flows through a check valve 17 and into the air cylinder 26 displacing the piston 28 to the right. This movement compresses the compression spring 32 and causes the actuator rod to enter the hole 20 in the latch member 18, thus locking the door 4 against opening. In the drawing, the extended position of the actuator rod 30 is shown by phantom lines marked by reference numeral 31.

When the air supply is discontinued, as by disengaging the extension 7 of knob 5 from the regulator 16, the check valve 17 prevents a reverse flow of air from the air cylinder 26. The effect of this is to retain the actuator rod 30 in the extended position 31. A small leak orifice 34 is provided on the pressurized end of the air cylinder 26 to enable the air pressure to drop at a predetermined rate. As the pressure drops below the restoring force of the spring 32, the piston is gradually retracted and the actuator rod 30 is withdrawn from engagement with the latch member 18, thereby unlocking the door 4. In the preferred embodiment, the size of the leak orifice 34 is selected so as to obtain a one minute delay in unlocking the door 4 after the air supply has been cut off. This allows sufficient time for the rotor 10 to reach a complete stop before the user gains access to the rotor chamber.

It will be apparent, therefore, that there has been provided in accordance with the invention, improved means for locking the door of a centrifuge. It will be understood that those skilled in the art may make various changes and modifications without departing from the invention and it is, therefore, the aim of the appended claims to cover all such changes and modifications as fall within the true spirit and scope of the invention.

We claim:

1. In an air driven centrifuge having an access door to a rotor chamber housing a rotor seat and a rotor having a plurality of turbine flutes formed in the underside thereof, said rotor seat having driving air jet means connected to a source of pressurized air for impinging pressurized air streams against said turbine flutes for supporting and spinning said rotor on an air cushion above said rotor seat within said chamber, the improvement comprising:

means for preventing the opening of said access door when pressurized air is supplied to said air jet means; and means for delaying, for a predetermined time, the opening of said access door after said supply of pressurized air to said air jet means is discontinued.

2. The centrifuge as recited in claim 1, wherein said means for preventing the opening of said access door when pressurized air is supplied to said air jet means comprises a latch member mounted on said access door, an air cylinder mounted on said centrifuge and an actuator rod extendable from said air cylinder into engagement with said latch member when actuated by pressurized air from said source supplying said air jet means thereby locking said door when said air source is actuated.

3. The centrifuge as recited in claim 2, wherein means are provided for delaying for a predetermined time the opening of said access door after the supply of pressurized air to said air jet means is discontinued, comprising:

means for establishing a predetermined leak rate in said air cylinder, a check valve connected to the inlet of said air cylinder to permit an inflow of air to said cylinder but substantially preventing any return of air back through the check valve, so that when the air supply is discontinued, the actuator rod of said cylinder remains in an extended position for a period of time corresponding to the leak rate of the cylinder, and spring means attached to said actuator rod for retracting said actuator rod from its extended position when said air supply is discontinued and the air pressure in said cylinder has dissipated.

4. The centrifuge of claim 3 wherein the leak rate of said cylinder is selected so as to return said actuator rod to its retracted position in approximately 1 minute after said air supply is discontinued.

5. In an air driven centrifuge having an access door to a rotor chamber housing a rotor seat and a rotor having a plurality of turbine flutes formed in the underside thereof, said rotor seat having driving air jet means connected to a source of pressurized air for impinging pressurized air streams against said turbine flutes for supporting and spinning said rotor on an air cushion above said rotor seat within said chamber, and an access door to said rotor chamber including means for preventing the opening of said access door when pressurized air is supplied to said air jet means, and means for delaying, for a predetermined time, the opening of said access door after said supply of pressurized air to said air jet means is discontinued, comprising:

an air cylinder having a predetermined leak rate mounted on said centrifuge and having an actuator rod extending to engage a latch member of said access door when actuated by pressurized air from a source supplying said air jet means;

a check valve connected to the inlet of said air cylinder permitting an inflow of air to said cylinder but substantially preventing any return of air back through the check valve, so that when the air supply is discontinued, the actuator rod of said cylinder remains in an extended position for a period of time corresponding to the leak rate of the cylinder, spring means attached to said actuator rod for retracting said actuator rod from its extended position when said air supply is discontinued and said air pressure in said cylinder has dissipated; and the leak rate of said cylinder is selected so as to retract said actuator rod from its extended position in approximately 1 minute after said air supply is discontinued.

6. In an air driven centrifuge having an access door to a rotor chamber housing a rotor seat and a rotor having a plurality of turbine flutes formed in the underside thereof, said rotor seat having driving air jet means connected to a source of pressurized air for impinging pressurized air streams against said turbine flutes for supporting and spinning said rotor on an air cushion above said rotor seat within said chamber, and an access door to said rotor chamber including means for preventing the opening of said access door when pressurized air is supplied to said air jet means, the improvement comprising:

means for delaying, for a predetermined time, the opening of said access door after said supply of pressurized air to said air jet means is discontinued, said delaying means including a latch member disposed on the underside of said access door and designed to extend through an opening in the body of said centrifuge when said access door is in the closed position, an air cylinder having a predetermined leak rate mounted inside the body of said centrifuge, said air cylinder having a cylindrical bore containing a piston connected to an actuator rod, said actuator rod extending outwardly from one end of said air cylinder when said air cylinder is actuated, a compression spring for retracting said actuator rod when said air supply is discontinued, a latch hole provided in said latch member adapted to receive said actuator rod in sliding engagement therewith to lock said access door, a pressure regulator connected to said source of pressurized air, the output of said regulator divided into two branches, one said branch supplying pressurized air to said air jet means, said other branch connected to a check valve, said check valve coupled to the inlet of said air cylinder and serving to prevent a reverse air flow when said supply of air is discontinued so that said retraction of said actuator rod from engagement with said latch member to unlock said access door is delayed for a predetermined time corresponding to the leak rate of said air cylinder.

* * * * *